US006196098B1

(12) United States Patent
Hagiwara et al.

(10) Patent No.: US 6,196,098 B1
(45) **Date of Patent: *Mar. 6, 2001**

(54) PAPER CUTTER FOR PHOTOGRAPHIC PROCESSING SYSTEM

(75) Inventors: Naoaki Hagiwara; Yuji Takenaka, both of Kanagawa (JP)

(73) Assignee: Fuji Photo Film Co., Ltd., Kanagawa-Ken (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/674,760

(22) Filed: Jul. 2, 1996

(30) Foreign Application Priority Data

Jul. 3, 1995 (JP) ..... 7-167443

(51) Int. Cl.[7] ..... B26D 5/32; G03D 15/04

(52) U.S. Cl. ..... 83/79; 83/76.8; 83/102; 83/210; 83/371; 83/649; 83/948

(58) Field of Search ..... 83/63, 102, 209, 83/371, 848, 27, 76.8, 79, 210, 211, 365, 367, 649

(56) References Cited

U.S. PATENT DOCUMENTS 3,699,832 * 10/1972 Smith et al. ..... 83/371 X
3,706,373 * 12/1972 Smith ..... 83/210 X
4,098,158 * 7/1978 Escales et al. ..... 83/371 X
4,147,080 * 4/1979 Diesch et al. ..... 83/210 X
4,221,144 * 9/1980 Diesch et al. ..... 83/210 X
4,255,994 * 3/1981 Strunc ..... 83/371 X
4,506,824 * 3/1985 Bartz ..... 83/371 X
4,821,061 * 4/1989 Gudmundson et al. ..... 83/371 X
4,949,607 * 8/1990 Yuito ..... 83/371 X
4,974,394 * 12/1990 Suzuki ..... 83/371 X
5,072,639 * 12/1991 Dolf ..... 83/209 X

* cited by examiner

*Primary Examiner*—Clark F. Dexter
(74) *Attorney, Agent, or Firm*—Sughrue, Mion, Zinn, Macpeak & Seas, PLLC

(57) ABSTRACT

A paper cutter is provided for a photographic processing system which processes photographic materials while collating the photographic materials on the basis of identification marks which have been recorded in advance, by codes which can be read by machine and by operator, on at least one of a photographic film for image recording and an accommodating body which accommodates the photographic film, said paper cutter cutting per print an elongated photographic printing paper on which images recorded on a photographic film have been printed successively and on which an index print has been printed in succession with the printed images. A bar code reader functions to read a bar code (an identification mark) applied to an index print. When conveying of a photographic printing paper is stable, the bar code reader opposes a bar code, and the conveying of the photographic printing paper is stopped. As a result, the bar code can be read accurately without relative positions of the bar code reader and the bar code being offset from one another.

5 Claims, 3 Drawing Sheets

PAPER CUTTER FOR PHOTOGRAPHIC PROCESSING SYSTEM

BACKGROUND OF THE INVENTION

1. Field of the Invention

The present invention relates to a paper cutter for a photographic processing system which processes photographic materials while collating the photographic materials on the basis of identification (ID) marks which have been recorded in advance, by codes which can be read mechanically and visually, on at least one of a photographic film for image recording and an accommodating body which accommodates the photographic film, the paper cutter cutting an elongated photographic printing paper on which images recorded on a photographic film have been printed successively and on which an index print has been printed in succession with the printed images.

2. Description of the Related Art

A photographic film is subjected to developing processing, and images are printed onto a photographic printing paper on the basis of the developed photographic film. The photographic printing paper is elongated and wound in a roll form, and the respective images are printed successively thereon.

An index print is printed in succession with the images which are printed successively (i.e., the index print is printed either in front of or after the printed images). In the index print, the images recorded on one photographic film are arranged and displayed in a matrix form on a single sheet.

The respective prints of the images and the index print which have been printed in succession are cut and separated by a paper cutter. The paper cutter also detects the existence of an unsatisfactory mark applied to the image surface of a print of an image, so as to be able to sort the satisfactory prints and the unsatisfactory prints.

In recent years, systems have been proposed in which an ID mark is applied to each photographic material (such as the photographic film, the prints, the index print and the like), and the photographic materials are verified by using these ID marks. Usually, a bar code ID mark which can easily be read by machine and an ID mark which an operator can perceive visually are both used.

In cases in which processing is to be carried out automatically, the bar codes must be read automatically, and a bar code reader must be provided at each conveying system.

Because the prints of the respective images are sorted and conveyed per photographic film, collation thereof is easy. However, index prints of a plurality of photographic films are conveyed in a state of being bundled together. Therefore, in order to ascertain in after-processes the order in which the index prints are stacked, the ID marks must be read when the index prints are cut and must be stored on a recording medium such as an LSI card or the like for information exchange with the after-processes.

In this case, the bar codes recorded on the cut index prints could be read. However, it is difficult to determine the relative positions of the bar code recording portions of the sheet-shaped index prints and the bar code reader provided at a predetermined position. Accordingly, there are cases in which the bar codes cannot be read accurately.

SUMMARY OF THE INVENTION

In view of the aforementioned, an object of the present invention is to provide a paper cutter for a photographic processing system in which, when an ID mark applied to an index print is read, the relative positions of the ID mark and an ID mark reading sensor can be maintained fixed so that the ID mark can be read reliably.

An aspect of the present invention is a paper cutter for a photographic processing system which processes photographic materials while collating the photographic materials on the basis of identification marks which have been recorded in advance, by codes which can be read by machine and by operator, on at least one of a photographic film for image recording and an accommodating body which accommodates the photographic film, the paper cutter cutting per print an elongated photographic printing paper on which images recorded on a photographic film have been printed successively and on which an index print has been printed in succession with the printed images, the paper cutter comprising: a loading section at which the elongated photographic printing paper is loaded; conveying means for withdrawing the photographic printing paper from the loading section and conveying the photographic printing paper; a verification section for verifying a finished state of prints, the verification section having a conveying/guiding portion, which linearly guides the photographic printing paper withdrawn from the loading section by the conveying means, and an unsatisfactory mark sensor, which, while the photographic printing paper is being conveyed by the conveying/guiding portion, detects unsatisfactory marks applied to the photographic printing paper; a cutter section for cutting the photographic printing paper which has passed through the verification section; control means for, on the basis of cut marks applied to the photographic printing paper in advance, temporarily stopping conveying of the photographic printing paper and operating the cutter section; a sorting section for sorting photographic printing papers cut by said cutter section; and an identification mark reading sensor disposed at the conveying/guiding portion and reading the identification marks while the conveying of the photographic printing paper is stopped.

In accordance with the present invention, the photographic printing paper loaded at the loading section is withdrawn, and is conveyed to the conveying/guiding portion by the conveying means. The conveying/guiding portion is provided with an unsatisfactory mark sensor which detects an unsatisfactory mark applied in advance on the image recording surface.

The control means controls the conveying means. On the basis of cut marks applied in advance, the control means temporarily stops the conveying by the conveying means, and operates the cutter section while the conveying is stopped, so as to cut the photographic printing paper. In this way, the photographic printing paper is cut per print (i.e., per image and per index print).

On the basis of the detection by the unsatisfactory mark sensor, the sorter section sorts the prints into satisfactory prints, unsatisfactory prints, and index prints.

The ID mark reading sensor is attached to the conveying/guiding portion. The ID mark reading sensor reads the ID mark applied to the index print due to the index print being stopped at the position at which the ID mark reading sensor is disposed. It is preferable that the ID mark reading sensor is disposed in a vicinity of the unsatisfactory mark sensor which has already been provided, so that there is no need to increase the mounting space.

The ID mark applied to the index print can easily be read by machine. A bar code, for example, is preferably used as the ID mark. Accordingly, a bar code reader can be used as the ID mark reading sensor.

The bar code reader usually reciprocally scans a laser light beam a plurality of times so that the bar code is read a plurality of times. In order to improve the accuracy in reading, the photographic printing paper must be stopped temporarily.

The bar code is usually applied to the index print along a direction orthogonal to the direction in which the photographic printing paper is conveyed at the paper cutter. For this reason as well, the photographic printing paper must be stopped temporarily.

DESCRIPTION OF THE PREFERRED EMBODIMENTS

Figure 1:
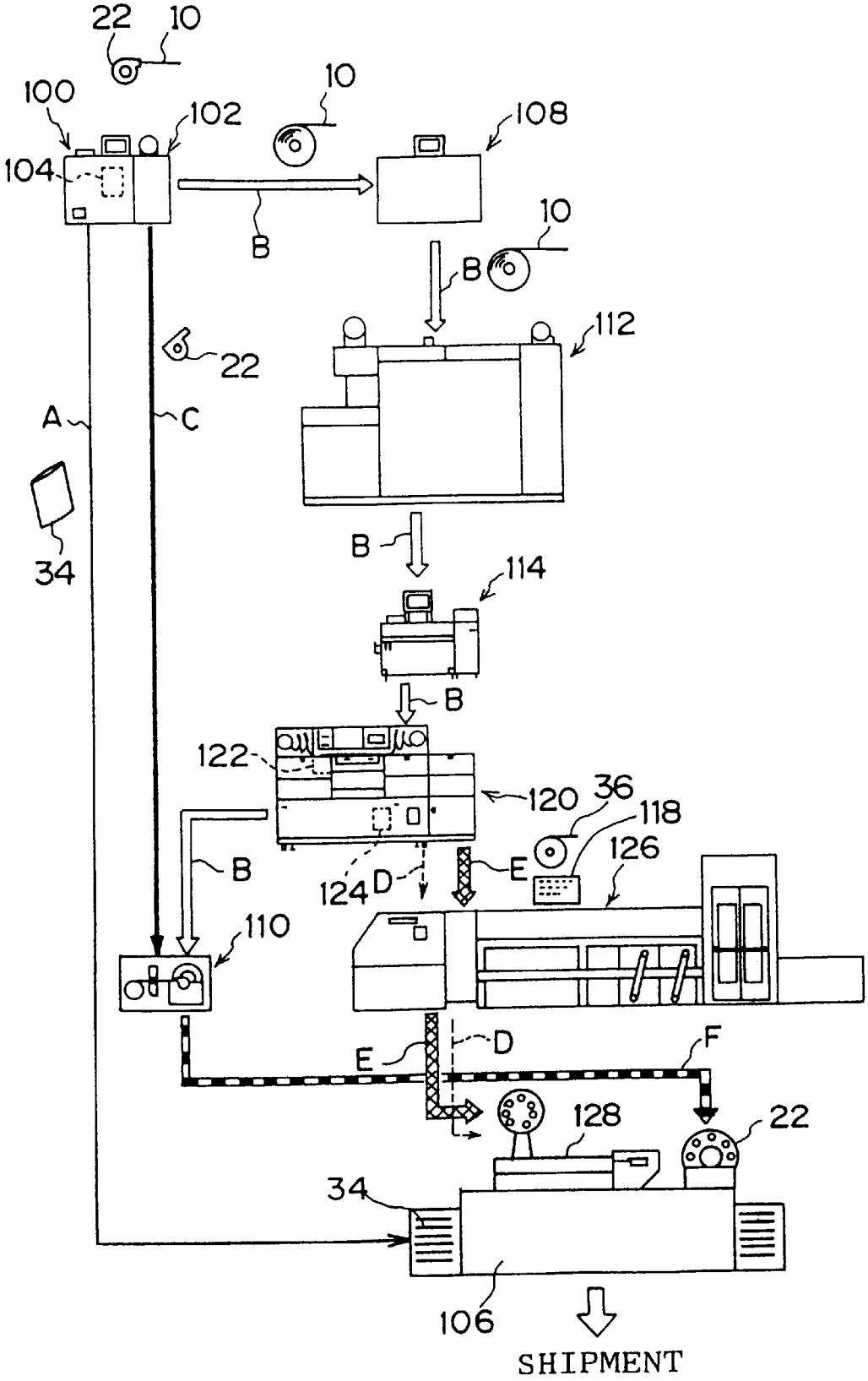
FIG. 1 is a view illustrating a photographic processing system at a large lab.

FIG. 1 is a schematic view of an apparatus which is often called a "large lab" and which serves as a photographic processing apparatus relating to the present embodiment.

In a film splicer 100 in a large lab, films 10 (accommodated in cartridges 22) which are conveyed in are successively joined together so as to form an elongated, rolled film 10.

When the cartridge 22 is set at the splicer 100, in order to obviate trouble in developing, a determination is made as to whether the film 10 accommodated in the cartridge 22 is a negative film, a positive film, or a black-and-white film (a black-and-white film or a color film). A film which is suitable for the developing which will be carried out later is discharged from its cartridge 22 by rotating the spool shaft. Whether the film has been developed is also verified by, for example, an infrared ray transmission sensor sensing the amount of transmitted light. If the film 10 has not been developed, the film 10 is further pulled out from the cartridge 22.

A detacher 102 is provided at the film splicer 100, so that when all of the film 10 has been withdrawn from the cartridge 22, the trailing end portion of the film 10 connected to the spool shaft within the cartridge 22 is detached. In this way, the film 10 is withdrawn from the cartridge 22, and plural films 10 can be joined together.

Here, if a magnetic recording layer is provided on the film 10, the ID mark recorded on the cartridge 22 is read and is recorded magnetically on the magnetic recording layer. Because the same ID mark as that recorded in advance on the cartridge 22 is also recorded on the film 10, this magnetically recorded ID mark may be used as a back-up mark.

When the cartridge 22 is delivered into the film splicer 100, a DP (Development and Print) bag 34 which was issued at a DPE (Development, Print, and Enlargement) shop accompanies the cartridge 22. (A DPE shop is a shop where a customer turns in their film and requests processing thereof.) After processings such as developing, printing and the like have been completed, the cartridge 22 and the photographic printing paper 36 are placed in the DP bag 34 and given to the customer. A bill is also attached to the DP bag 34. Accordingly, a character printing device 104, which reads the ID mark recorded on the cartridge 22 and prints this ID mark on the DP bag 34, is provided in the present embodiment. The ID mark is used to collate the cartridge 22 and the like during final shipment thereof. When the cartridge 22 is removed from the DP bag 34, as illustrated by thin arrow A in FIG. 1, the DP bag 34 is sent to a collating section 106 which is provided before shipment. At this time, the DP bags are gathered together in a lot which corresponds to the film roll and are sent to the collating section 106.

After the film 10 and the cartridge 22 are separated by the film splicer 100, the film 10 is conveyed to a verification device 108 (refer to the thick, white arrow B in FIG. 1), and the cartridge 22 is conveyed to an attacher 110 (refer to the thick, black arrow C in FIG. 1).

After the joining of the films is checked at the verification device 108, the film 10 is sent to a film processor 112. At the film processor 112, the film is conveyed through processing tanks for developing, fixing, rinsing and the like, and is subjected to drying processing so as to be developed. The developed film is wound in a roll form and is conveyed to a scanner 114.

At the scanner 114, the images recorded on the film 10 are read by an image pick-up element such as a CCD or the like, and exposure correction data is prepared on the basis of the image information. Further, the image information itself is supplied to an index print section of a printer 120 (refer to the chain line D in FIG. 1).

A liquid crystal display panel (unillustrated), which displays images on the basis of the image information (digital information), is provided at the index print section. Image frames of five images to ten images can be displayed at a single time on the liquid crystal display panel. (In the present embodiment, ten images are displayed, five vertically by two horizontally.)

Light of RGB colors is transmitted through the liquid crystal display panel so that the images are exposed onto a rolled photographic printing paper. By repeating this process, the images of one film are recorded in a matrix format onto the photographic printing paper. This sheet is called an index print 118, and is given to the customer together with the cartridge 22 and the photographic printing paper 36.

The printer 120 is provided with an ID mark reading device 122 which reads ID marks from the film 10. On the basis of the data read by the ID mark reading device 122, the printer 120 records onto the index print 118 the ID mark recorded on the film 10 as a unique mark. A bar code format ID mark and a character (numerical) format ID mark are used jointly. The bar code is provided along a direction orthogonal to the conveying direction of the photographic printing paper.

At the printer 120, the image frames of the rolled film 10 are successively positioned at the printing position, and transmitted images are printed onto the photographic printing paper 36 at predetermined exposure amounts. By carrying out this process successively, images are successively printed onto the photographic printing paper 36. At the index print section, the index print 118 is successively prepared each time the printing of the images of one film 10 is completed.

An ID mark printing device 124, which prints the ID marks read by the ID mark reading device 122 onto the obverse surface or the reverse surface of the photographic printing paper 36 in correspondence with the respective images, is provided at the printer 120. Printing of the ID marks is thereby carried out in parallel with the printing of images from the respective image frames.

In order to return a film for which printing processing has been completed to the customer, the film is conveyed to the attacher 110. Further, the photographic printing paper 36 is conveyed to a paper processor 126 (refer to the arrow E marked by meshing in FIG. 1) where developing processing is carried out.

At the paper processor 126, the photographic printing paper 36 which has been subjected to printing processing undergoes various processings such as developing, fixing, rinsing and drying processings. Thereafter, the photographic printing paper 36 wound in a roll form is conveyed as is to a paper cutter 128.

Figure 2:
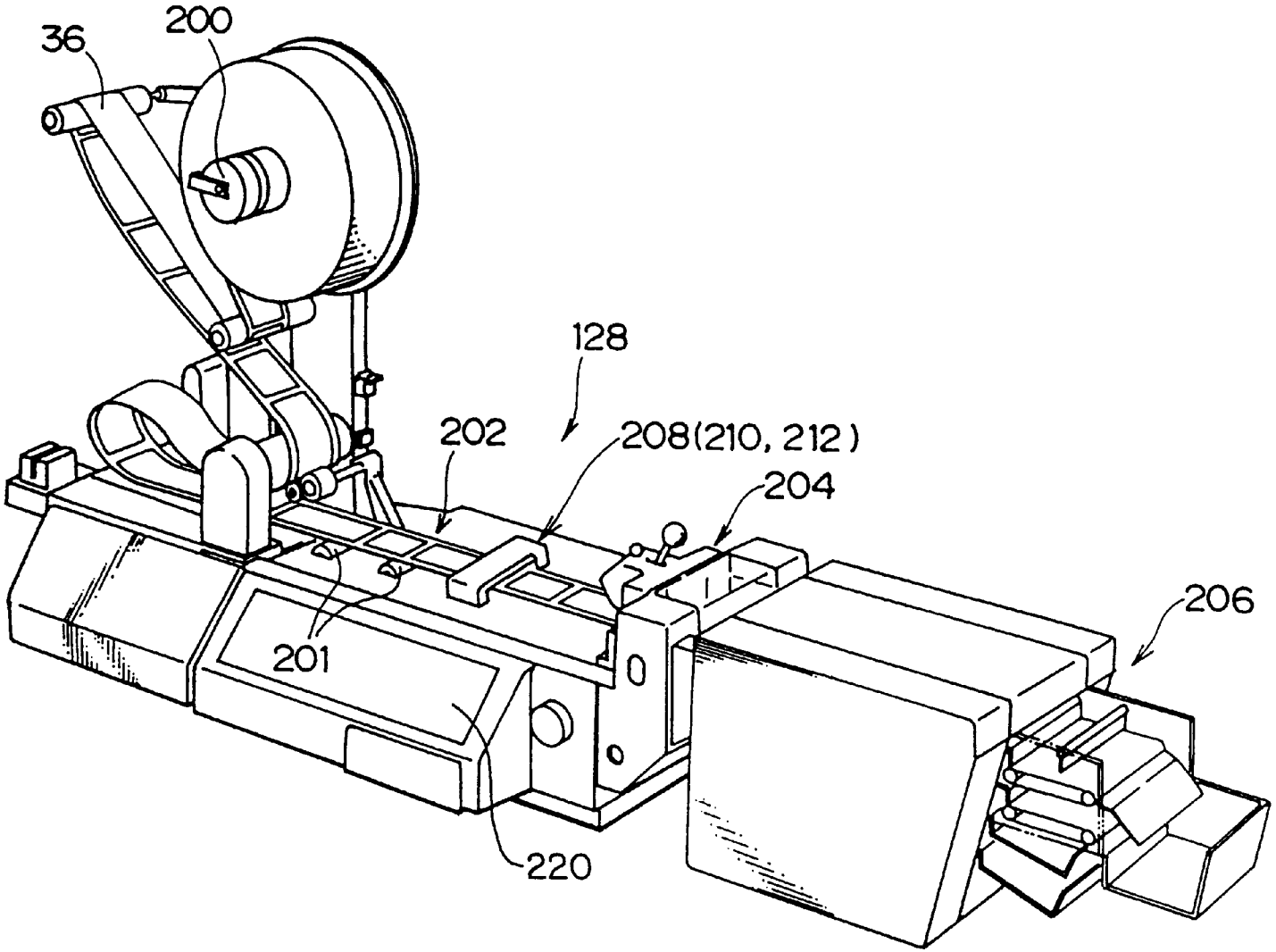
FIG. 2 is a perspective view illustrating a paper cutter in the photographic processing system of FIG. 1.
Figure 3:
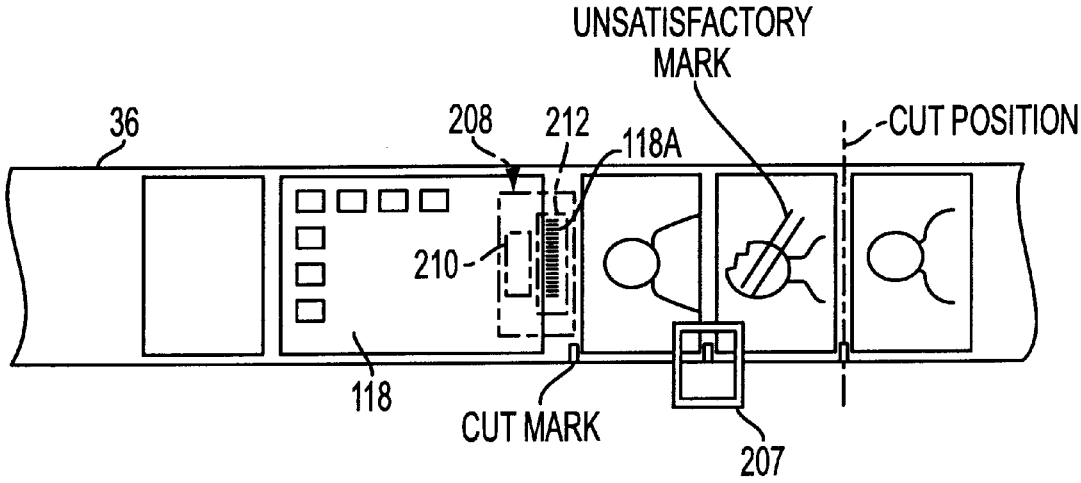
FIG. 3 is a plan view of a conveying section of the paper cutter, which illustrates relative positions of a bar code reader and a bar code on an index print.

As illustrated in FIG. 2, the paper cutter 128 is provided with a loading shaft 200 which serves as a loading section and onto which the rolled photographic printing paper 36 is loaded. The photographic printing paper 36 can be pulled out from the outermost layer thereof.

The photographic printing paper 36 which has been withdrawn from the loading shaft 200 is guided to a conveying section 202 by driving rollers 201. At the conveying section 202, the photographic printing paper 36 is conveyed substantially linearly while the transverse direction ends thereof are guided by guide members, and the photographic printing paper 36 reaches a cutter section 204.

At the cutter section 204, the photographic printing paper 36 is cut per image, and the index print is separated. The conveying of the photographic printing paper 36 is temporarily stopped while the cutter section 204 is cutting and separating the images and the index prints.

A sorter section 206 is provided downstream of the cutter section 204, and sorts the photographic printing papers 36 and the index prints 118.

A sensor unit section 208 is provided above the conveying path of the above-described conveying section. An unsatisfactory mark sensor 210 and a bar code reader 212 are disposed in the sensor unit section 208.

The unsatisfactory mark sensor 210 detects the existence of a mark (a diagonal line or the like) which has been applied on the image due to a previous inspection. The unsatisfactory mark sensor 210 functions to differentiate between satisfactory prints and unsatisfactory prints. The satisfactory prints and the unsatisfactory prints are sorted in the sorter section 206.

The bar code reader 212 serves to read the bar codes (ID marks) applied to the index prints 118.

Full size images, high vision size images, and panorama size images are printed onto the photographic printing paper 36. The photographic printing paper 36 may include images of only one size, or may include images of various sizes. The lengths of full size images, high vision size images and panorama size images in the conveying direction are respectively different. Further, the index print 118 may have either of two different lengths in the conveying direction of the photographic printing paper, in accordance with the number of frames which can be photographed on the film 10.

In the present embodiment, the index print 118 is printed immediately after all of the images of one film 10 have been printed. Due to the above-described sizes, when the cutter section 204 is operated, i.e., when the photographic printing paper is stopped, the bar code reader 212 does not always oppose the bar code (ID mark) applied to the index print 118. However, when an image of a size which is printed most frequently is printed (e.g., full size images or long index prints), the bar code reader 212 is disposed at a position which exactly opposes a bar code 118A when the conveying of the photographic printing paper 36 is stopped when the cutter section 204 is operated.

As a result, when the conveying of the photographic printing paper 36 is stopped, the bar code reader 212 scans the bar code 118A a plurality of times and reads the bar code 118A. In a case in which the photographic printing paper 36 includes images of other sizes, conveying thereof is temporarily stopped in order to read bar codes (ID marks) at times which do not coincide with the cutting operation of the cutter section 204.

At the paper cutter 128, the ID marks printed on the respective photographic printing papers 36 which have been cut per image are also read.

The rolled film 10, for which developing processing, printing processing and the like have been completed, is set at the attacher 110. Further, the cartridges 22 are set at the attacher 110 in the order in which the films 10 were joined. By placing the empty cartridges in a stocker in the order in which the films 10 were joined at the splicer, the joined order can easily be maintained. Further, if the stocker corresponds to the rolled film lot, collation is facilitated and moving of the cartridges is also convenient.

An ID mark reader is disposed on the conveying path along which the outermost layer of the set, rolled film 10 is pulled out and conveyed. The ID mark reader reads the ID marks of the films 10. An ID mark reader is disposed at the position at which the cartridge 22 is set, and reads the ID mark of the cartridge 22.

Because the cartridges 22 are set in the order in which the films 10 are joined, the order of the cartridges 22 usually coincides with the order of the films 10. However, there are cases in which the order becomes disturbed due to trouble in the conveying. By collating the read ID mark of the film and the read ID mark of the cartridge, it can be confirmed whether the ID marks match. When the ID marks do match, the joined portion of the film 10 is separated, and thereafter, the film 10 is accommodated as is in the cartridge 22. In this way, operation for cutting each of the films 10 can be eliminated.

The cartridge 22 in which the film 10 has been accommodated is conveyed to the collating section 106 as illustrated by the black-and-white striped arrow F in FIG. 1. The DP bag 34 is also sent to the collating section 106.

At the collating section 106, the respective ID marks recorded on the DP bag 34, the cartridge 22, the photographic printing papers 36, and the index print 118 are collated. When the ID marks match, the cartridge 22, the photographic printing papers 36, and the index print 118 are placed in the DP bag 34 and shipped.

Operation of the present embodiment will be described hereinafter.

First, a customer brings a cartridge 22 which contains a film 10 which has been photographed to a DPE shop and requests, for example, simultaneous prints. At the DPE shop, the DP bag 34 is issued, and the customer's name and telephone number, the name of the film manufacturer, the film type and the like are written in on an order form. The cartridge 22 is then placed in the DP bag 34.

The DP bag 34 which has been received at the DPE shop as described above is sent to a laboratory where it is first conveyed to the film splicer 100.

At the film splicer 100, the ID mark recorded on the cartridge 22 is read, and this ID mark is printed on the DP bag 34. The DP bag 34 on which the ID mark has been printed is then conveyed to the collating section 106.

Next, the film 10 is withdrawn from the cartridge 22, and is wound in a roll form.

When the film 10 has been completely withdrawn, the film 10 is temporarily separated from the cartridge 22. The cartridge 22 is then conveyed to the attacher 110.

The films 10 are successively joined together such that the trailing end of one film 10 is joined to the leading end of the next film 10. A roll of a predetermined number of films 10 is prepared, and this rolled film 10 is conveyed as is to the film processor 112.

At the film processor 112, the rolled film 10 is guided by a leader, and is subjected to various processings such as developing processing, fixing processing, rinsing processing, drying processing and the like such that the images are developed.

The rolled film 10 for which developing processing and the like have been completed at the film processor 112 is conveyed to the scanner 114. At the scanner 114, the images of the respective image frames are read by an image pick-up element such as a CCD or the like, and exposure correction data is prepared.

The film 10 whose images have been read by the scanner 114 is then sent to the printer 120.

The read image data is sent to the index print section of the printer 120. Synchronously with the printing processing of the respective images (i.e., in the present embodiment, each time printing processing of the images of one film is completed), the images of one film 10 are recorded in a matrix format on the basis of the image data, so as to prepare an index print 118. Even if the film 10 is returned to the customer in a state of being accommodated within the cartridge 22, the images recorded on the film 10 can be easily seen due to the index print 118.

Further, at the printer 120, the ID marks recorded on the respective films 10 are read and are sent to the index print section. At the index print section, the ID marks are printed onto the index prints 118 (both a bar code type ID mark and a character (numerical) type ID mark are used).

Due to the ID mark printed on the index print 118, collation of the index print 118 with other photographic materials is facilitated.

At the printer 120, the image frames recorded on the film 10 are successively positioned at the printing opening. The images are printed by the transmitted light being exposed onto the photographic printing paper 36 via an optical system.

An ID mark is recorded at the leading end of each of the films 10 which are joined together. These ID marks are read at the printer 120, and are printed on the obverse surface or the reverse surface of the photographic printing paper 36 so as to correspond to each of the images printed thereon. Accordingly, the same ID mark for one film is printed on the photographic printing paper 36. The frame number, information recorded at the camera, or the like may also be printed together with the printing of the ID mark.

The film 10 which has undergone processing at the printer 120 is conveyed to the attacher 110. At the attacher 110, the films previously joined together are separated from each other, and the films 10 are respectively accommodated in their original cartridges 22. More specifically, the ID mark recorded on one film 10 which has been separated is read. The cartridges 22 which have been conveyed in from the film splicer 100 are set at a predetermined position in the order in which the films 10 were joined. At this set position, the ID mark recorded on the cartridge 22 is read. Here, a determination is made as to whether the ID marks match. When it is determined that the ID marks match, the trailing end portion of the film 10 is inserted into the cartridge 22 by using a guiding member, and the film 10 is again engaged with the cartridge 22. After this engagement has been completed, a spool shaft is rotated so that the film 10 is successively taken up and completely accommodated within the cartridge 22.

The cartridge 22 in which the film 10 is accommodated is conveyed from the attacher 110 to the collating section 106.

The rolled photographic printing paper 36 on which images have been printed at the printer 120 (i.e., the prints of each image and the index print 118) is conveyed to the paper processor 126 where the photographic printing paper 36 is subjected to various processings such as developing processing, fixing processing, rinsing processing drying processing and the like, so as to be developed. The photographic printing paper 36 is then conveyed to the paper cutter 128.

At the paper cutter 128, the rolled photographic printing paper 36 is loaded on the loading shaft 200, and is pulled out from the outermost layer thereof so as to reach the conveying section 202. The unsatisfactory mark sensor 210 is provided above the conveying section 202, and detects the existence of an unsatisfactory mark applied in advance, so as to differentiate between satisfactory prints and unsatisfactory prints.

While the printed state is being differentiated, at the paper cutter 128, the conveying of the photographic printing paper 36 is temporarily stopped per image on the basis of the cut marks applied in advance which are detected by a sensor 207, and the cutter section 204 is operated so that the photographic printing paper 36 is cut per image. At this time, the index print 118 is also separated. A controller 220 is provided to control this operation.

At the sorter section 206, the prints are classified into satisfactory prints, unsatisfactory prints and index prints 118, and are sorted.

In the paper cutter 128 of the present embodiment, the bar code reader 212 is provided adjacent to the unsatisfactory mark sensor 210. The bar code reader 212 reads the bar code 118A applied to the index print 118. If the bar code is positioned so as to oppose the bar code reader 212 at the time the most frequently used print size is cut (e.g., full size images and long index prints 118), the number of times the photographic printing paper 36 is stopped can be decreased at this time only.

Plural scans are carried out when the photographic printing paper 36 is stopped. The scanning direction is orthogonal to the direction in which the photographic printing paper 36 is conveyed. However, because the conveying of the photographic printing paper 36 is stopped, the bar code can be read reliably and accurately. In this way, the ID marks of the index prints 118 are read in the order in which the index prints 118 were bundled together at the sorter section 206.

Because the conveying of the photographic printing paper is stable, the bar code can be read accurately without the relative positions of the bar code and the bar code reader 212 being offset from one another.

The DP bag 34, the index print 118, the cartridge 22 and the photographic printing paper 36 are all present at the collating section 106. If the ID marks recorded respectively thereon match, the cartridge 22, the index print 118 and the photographic printing papers 36 are placed in the DP bag 34. The bill is attached to the DP bag 34 which is then shipped. The shipped DP bags 34 are sent to the respective DPE shops at which processing was requested, and are given to the appropriate customers thereat.

In this way, ID marks are recorded on all of the photographic materials, and processing advances with the ID marks being collated at each section. Therefore, even if the photographic materials are conveyed and processed out of order, the materials can eventually be matched reliably without having to rely on troublesome manual labor involved in confirming the respective images.

In accordance with the present embodiment, the bar code reader 212, which reads the bar code (ID mark) applied to the index print 118, is provided at the paper cutter 128. Further, in the paper cutter 128, the bar code reader 212 and the bar code 118A are provided at positions which oppose one another during the time that the photographic printing paper 36 is temporarily stopped, which temporary stopping was also required in the conventional art. Therefore, in the present embodiment, the time for reading the bar code overlaps with the range of time in which processing is carried out at the cutter section 204, so that there is substantially no increase in the processing time. Accordingly, bar code reading processing can be carried out without a deterioration in workability.

As described above, in the paper cutter for a photographic processing system relating to the present invention, a superior effect is achieved in that while the ID mark applied to the index print is being read, the relative positions of the ID mark and the ID mark reading sensor can be held fixed. Therefore, the ID mark can be read reliably.

What is claimed is:

1. A device for a photographic processing system which processes photographic materials while collating the photographic materials on the basis of unique identification marks, which have been recorded in advance on an elongated photographic printing paper and which correspond to marks provided on at least one of a photographic film for image recording and an accommodating body which accommodates the photographic film, said device cutting per print said elongated photographic printing paper on which images recorded on said photographic film have been printed successively and on which an index print has been printed in succession with the printed images, said device comprising:

a loading section at which the elongated photographic printing paper is loaded;

conveying means for withdrawing the photographic printing paper from said loading section and conveying the photographic printing paper;

a cutter disposed along said conveying means and downstream of said loading section for cutting the photographic printing paper;

sorting means for sorting photographic printing papers cut by said cutter;

an identification mark reading sensor disposed proximate said conveying means for reading the unique identification marks;

a sensor for sensing cut marks applied to said photographic printing paper in advance; and control means, responsive to said sensor, for temporarily stopping conveying of the photographic printing paper and operating said cutter to cut said photographic printing paper and operating said identification mark reading sensor to read the unique identification marks.

2. A device according to claim 1, wherein said sorting means sorts photographic printing papers into index prints and other types of prints on the basis of the identification marks read by said identification mark reading sensor.

3. A device according to claim 1, further comprising an unsatisfactory mark sensor disposed along said conveying means, which detects unsatisfactory marks applied to the photographic printing paper while the photographic printing paper is being conveyed by said conveying means.

4. A device according to claim 3, wherein said sorting means sorts said photographic printing paper into index prints, satisfactory prints and unsatisfactory prints on the basis of the identification marks read by said identification mark reading sensor and the unsatisfactory marks read by said unsatisfactory mark sensor.

5. A paper cutter according to claim 1, wherein said unique identification marks are bar codes and said identification mark reading sensor is a bar code reader.

* * * * *